US009169534B2

(12) United States Patent
Berni et al.

(10) Patent No.: US 9,169,534 B2
(45) Date of Patent: Oct. 27, 2015

(54) RECOVERY OF BASE METALS FROM SULPHIDE ORES AND CONCENTRATES

(71) Applicant: VALE S/A, Rio de Janeiro (BR)

(72) Inventors: Tiago Valentim Berni, Belo Horizonte (BR); Antonio Clareti Pereira, Belo Horizonte (BR); Felipe Hilario Guimarães, São José da Lapa (BR)

(73) Assignee: VALE S.A., Rio de Janeiro (BR)

( * ) Notice: Subject to any disclaimer, the term of this patent is extended or adjusted under 35 U.S.C. 154(b) by 181 days.

(21) Appl. No.: 13/948,929

(22) Filed: Jul. 23, 2013

(65) Prior Publication Data

US 2014/0020510 A1 Jan. 23, 2014

Related U.S. Application Data

(60) Provisional application No. 61/674,624, filed on Jul. 23, 2012.

(51) Int. Cl.

| | |
|---|---|
| ***C22B 5/00*** | (2006.01) |
| ***C22B 15/00*** | (2006.01) |
| ***C22B 23/00*** | (2006.01) |
| ***C22B 19/20*** | (2006.01) |
| ***C22B 1/02*** | (2006.01) |
| ***C22B 1/04*** | (2006.01) |
| ***C22B 1/08*** | (2006.01) |
| ***C22B 3/00*** | (2006.01) |
| ***C22B 1/06*** | (2006.01) |

(52) U.S. Cl.

CPC ... *C22B 5/00* (2013.01); *C22B 1/02* (2013.01); *C22B 1/06* (2013.01); *C22B 1/08* (2013.01); *C22B 15/0026* (2013.01); *C22B 19/20* (2013.01); *C22B 23/005* (2013.01); *C22B 23/04* (2013.01)

(58) Field of Classification Search

CPC ..... C22B 5/00; C22B 15/0026; C22B 23/04; C22B 23/005; C22B 19/20; C22B 1/02; C22B 1/06; C22B 1/08

See application file for complete search history.

(56) References Cited

U.S. PATENT DOCUMENTS

| | | | | |
|---|---|---|---|---|
| 3,919,079 | A | 11/1975 | Weston | |
| 4,283,017 | A | 8/1981 | Coale et al. | |
| 4,308,058 | A | 12/1981 | Mäkipirtti et al. | |
| 5,281,252 | A | 1/1994 | Landolt et al. | |
| 8,173,086 | B2 * | 5/2012 | Pereira et al. | 423/138 |

FOREIGN PATENT DOCUMENTS

WO WO 2011006223 A1 * 1/2011

* cited by examiner

*Primary Examiner* — Gerorge Wyszomierski
*Assistant Examiner* — Tima M McGuthry Banks
(74) *Attorney, Agent, or Firm* — Arent Fox LLP

(57) ABSTRACT

A method of recovering base metals from sulphide ores and concentrates includes mixing the base metals ore with ferric salts, heating the mixture, adding water to form a pulp, and stirring and filtering the pulp.

10 Claims, No Drawings

RECOVERY OF BASE METALS FROM SULPHIDE ORES AND CONCENTRATES

This application claims priority from U.S. Patent Application No. 61/674,624, titled "Recovery of Base Metals from Sulphide Ores and Concentrates," filed on Jul. 23, 2012, and which is incorporated herein by reference in its entirety.

BACKGROUND OF THE INVENTION

This invention relates to the recovery of base metals from sulphide ores and concentrates.

Conventional processing of base metals sulphide ores includes flotation and pyrometallurgical techniques as smelting of concentrates.

U.S. Pat. No. 4,283,017 describes a selective flotation of cubanite and chalcopyrite from copper/nickel mineralized rock. The disadvantage of this process consists in the ore beneficiation process, which requires high energy consume in order to reach very fine particles. The present invention can be fed with coarse particles.

U.S. Pat. No. 3,919,079 describes a process of flotation of sulphide minerals from sulphide bearing ore. The disadvantage of this process consists in the flotation process which use complex reagents: Dispersant, Collector, Alkali, Floculants. The complex reagents used in the flotation can cause environmental impact due to chemical oxygen demand for the decomposition of these reagents. The present invention does not require complex reagents.

U.S. Pat. No. 5,281,252 describes a conversion of non-ferrous sulfides which requires the insufflation of the copper sulphide particles and this process requires a complex control of agitation levels and contact of solid/liquid. Further, it requires the control of the internal atmosphere to ensure the reduction of the copper and the power supply for the reaction.

U.S. Pat. No. 4,308,058 describes a process for the oxidation of molten low-iron metal matte to produce raw metal. This process, however, requires multiple furnace operations as well as high temperatures (>1000° C.) which involves high energy consumption.

However these conventional processes become very expensive when dealing with low grade material and ores with high impurities content like chlorine and fluorine. Another problem with pyrometallurgical processing is the high capital of costs of a new plant, environmental, issues and high energy consumption.

Usually, when dealing with low grade material and ores with high impurities content, the gases resulting (dust; $CO_2$; NOx; $H_2O$) from the process must be treated before sending the $SO_2$ to a sulphuric acid plant. Alternative methods comprise burning the concentrate.

BRIEF DESCRIPTION OF THE INVENTION

In light of the above described problems and unmet needs, the present invention provides an advantageous and effective a process of indirect and selective sulfation of base metals in the form of sulfides. This process can be applied for both concentrates or for low-grade sulfide ores; the greater focus being on the latter. Low-grade sulfide ores usually do not reach the desired content in the concentrate; and when they hit it, big losses happen. Impurities are the major problem. For this reason, the process described herein had been proposed.

More specifically, the present invention discloses a recovery of base metals from sulphide ores and concentrates, which comprises mixing the base metal's ore with ferric salts whose ratios are between 50% and 200% to base metals, heating the said mixture to temperatures between 400° C. and 600° C. for a period of 2 to 8 hours; adding water to form a pulp, then stirring and filtering the pulp.

Additional advantages and novel features of these aspects of the invention will be set forth in part in the description that follows, and in part will become more apparent to those skilled in the art upon examination of the following or upon learning by practice of the invention.

DETAILED DESCRIPTION OF THE INVENTION

The following detailed description does not intend to, in any way, limit the scope, applicability or configuration of the invention. More exactly, the following description provides the necessary understanding for implementing the exemplary modalities. When using the teachings provided herein, those skilled in the art will recognize suitable alternatives that can be used, without extrapolating the scope of the present invention.

The process of the present invention involves mixing the ore, concentrate or other sulphide material containing base metals with ferric sulfate or chloride in a screw mixer. The salt can come in a hydrated or anhydrous form. The mixture may have a ratio of 1:0.001 to 1:1000 of the sulphide material and the anhydrous salt. If a hydrated salt is used, the ratios may be changed proportionally.

Preferred ratios are between 50% and 200% to base metals considering the stoichiometry, preferably between 90 and 120% for the anhydrous form. It is a particularly attractive process once the deposit of the sulphide content is low and the concentration by flotation does not produce a concentrate of good quality. It is also effective if the concentration of fluorine and chlorine are above the specification limits.

This final mixture is later taken to a kiln, a furnace or any other equipment known by those skilled in the art, providing enough heat to reach temperatures preferably between 400° C. and 600° C., more preferably between 400° C. and 500° C. at atmospheric pressure in any kind of mixing apparatus. At that temperature, the following reaction occurs for a generic base metal sulphide:

$$3\ MS+Fe_2(SO_4)_3+4.5\ O_2=3\ NiSO_4+Fe_2O_3+3\ SO_2$$

(where M represents a base metal).

Base metals are preferably copper, nickel and zinc, more preferably nickel.

Ferric sulfate is used as an example, as ferric chloride may also be used, changing reaction stoichiometry. Residence time is estimated to be preferably between 2 and 8 hours, more preferably for a period of 5 to 6 hours.

The production of ferric sulfate can be done in several ways by those skilled in the art.

Alternatively, oxide material can also be added to this mixture, providing the following reaction:

$$MS+3\ MO+Fe_2(SO_4)_3+2\ O_2=4\ NiSO_4+Fe_2O_3$$

(where M represents a base metal).

Base metals are preferably copper, nickel and zinc, more preferably nickel.

The above reaction would capture $SO_2$, avoiding gas scrubbing. To capture fluorine or chlorine in solid form, a borate source such as, for example, boric acid, amorphous silica or any other reagent known by those skilled in the art can be added.

The final product from the kiln is taken to a dissolution stage, in order to solubilize most or all of the base metal salts. It is mixed with water to form a pulp of 10%-33% solids, preferably between 20% and 30%. The pulp should be kept under stirring for a period of 1-5 hours, preferably between 2 and 4 hours. From that point, any downstream choice, such as filtering, also known by those skilled in the art, can be selected for further processing and purification of the base metals.

Therefore, aspects of the process of the present invention involve mixing the salt (e.g. ferric chloride or sulfate) with a Ni concentrate at a temperature between 400° C. and 600° C. and for a period of 2 to 8 hours.

In a preferred embodiment of the present invention, mixing the salt (e.g. ferric chloride or sulfate) with a Ni concentrate is at a temperature between 400° C. and 500° C. and for a period of 5 to 6 hours, obtaining the Ni sulfates or chlorides that are taken to the dissolution stage. According to various aspects, the Ni sulfates and chlorides may be taken directly to the dissolution stage. The process enables the achievement of a very stable residue (hematite) and the rapid dissolution of salts.

It is estimated that the efficiency is between 80 and 95%

Optionally, conventional downstream processes such as production of MHP and electrolysis can be used after the present process in view to obtain the product of any kind of interest.

The user sets whether to produce a high purity, such as electrolytic nickel, or an intermediate product as MHP. These options are not exhaustive, but only examples of downstream. This downstream would be greatly simplified, since the step of removing impurities from solution (such as Fe and Al) is no longer necessary.

The advantages of the process of the present invention maybe numerous and may include one or more of:

- better deposit exploration including deposits of low-sulfide which would not be economically viable for conventional flotation processes;
- reduced acid consumption;
- better settling properties of pulp;
- reduced consumption of flocculants;
- high levels of fluorine and chlorine would be no problem in the process of the present invention;
- This process is selective for the base metals. Thus, impurities such as iron and aluminum are not dissolved and these impurities in the conventional process downstream produce hydroxides which are very bulky and hard to decanting. As these elements are stable oxides (in the case of iron, are expected to stabilize as hematite), both the amount of solids formed would be lower as the ease of decanting of solid would be faster, thereby reducing the consumption of flocculants;
- The acidity of the solution obtained is low, reducing the need for neutralization.
- Below, are shown the thermodynamic data of the reactions proposed (for nickel and copper).

3CuS+Fe2(SO4)3+4.502(g)=3CuSO4+Fe2O3+3SO2(g)

| T C. | deltaH kcal | deltaS cal/K | deltaG kcal | K | Log(K) |
|---|---|---|---|---|---|
| 0.000 | −304.425 | −64.106 | −286.915 | 3.820E+229 | 229.582 |
| 100.000 | −304.796 | −65.321 | −280.422 | 1.793E+164 | 164.254 |
| 200.000 | −304.640 | −64.969 | −273.900 | 3.357E+126 | 126.526 |
| 300.000 | −304.226 | −64.181 | −267.440 | 9.707E+101 | 101.987 |
| 400.000 | −303.612 | −63.198 | −261.071 | 5.863E+084 | 84.768 |
| 500.000 | −302.857 | −62.154 | −254.803 | 1.077E+072 | 72.032 |
| 600.000 | −301.954 | −61.058 | −248.641 | 1.739E+062 | 62.240 |
| 700.000 | −300.882 | −59.895 | −242.596 | 3.066E+054 | 54.487 |
| 800.000 | −300.560 | −59.577 | −236.625 | 1.561E+048 | 48.193 |

-continued

| T C. | deltaH kcal | deltaS cal/K | deltaG kcal | K | Log(K) |
|---|---|---|---|---|---|
| 900.000 | −300.441 | −59.470 | −230.674 | 9.473E+042 | 42.976 |
| 1000.000 | −300.432 | −59.462 | −224.728 | 3.803E+038 | 38.580 |

NiS+3NiO+Fe2(SO4)3+2O2(g)=4NiSO4+Fe2O3

| T C. | deltaH kcal | deltaS cal/K | deltaG kcal | K | Log(K) |
|---|---|---|---|---|---|
| 0.000 | −220.408 | −93.107 | −194.976 | 1.034E+156 | 156.015 |
| 100.000 | −220.330 | −92.921 | −185.656 | 5.570E+108 | 108.746 |
| 200.000 | −220.086 | −92.330 | −176.400 | 3.066E+081 | 81.487 |
| 300.000 | −219.978 | −92.150 | −167.162 | 5.578E+063 | 63.746 |
| 400.000 | −220.766 | −93.311 | −157.954 | 1.935E+051 | 51.287 |
| 500.000 | −219.711 | −91.854 | −148.695 | 1.086E+042 | 42.036 |
| 600.000 | −218.366 | −90.221 | −139.589 | 8.751E+034 | 34.942 |
| 700.000 | −216.651 | −88.363 | −130.660 | 2.219E+029 | 29.346 |
| 800.000 | −215.462 | −87.199 | −121.884 | 6.669E+024 | 24.824 |
| 900.000 | −214.234 | −86.106 | −113.219 | 1.241E+021 | 21.094 |
| 1000.000 | −220.102 | −90.782 | −104.524 | 8.792E+017 | 17.944 |

CuS+3CuO+Fe2(SO4)3+2O2(g)=4CuSO4+Fe2O3

| T C. | deltaH kcal | deltaS cal/K | deltaG kcal | K | Log(K) |
|---|---|---|---|---|---|
| 0.000 | −191.154 | −92.312 | −165.939 | 6.034E+132 | 132.781 |
| 100.000 | −191.055 | −92.055 | −156.704 | 6.132E+091 | 91.788 |
| 200.000 | −190.411 | −90.547 | −147.568 | 1.472E+068 | 68.168 |
| 300.000 | −189.440 | −88.694 | −138.605 | 7.182E+052 | 52.856 |
| 400.000 | −188.215 | −86.730 | −129.833 | 1.432E+042 | 42.156 |
| 500.000 | −186.776 | −84.740 | −121.260 | 1.905E+034 | 34.280 |
| 600.000 | −185.114 | −82.721 | −112.886 | 1.810E+028 | 28.258 |
| 700.000 | −183.215 | −80.662 | −104.719 | 3.309E+023 | 23.520 |
| 800.000 | −181.998 | −79.469 | −96.716 | 4.989E+019 | 19.698 |
| 900.000 | −180.917 | −78.506 | −88.818 | 3.528E+016 | 16.548 |
| 1000.000 | −179.881 | −77.658 | −81.011 | 8.082E+013 | 13.907 |

As can be seeing, the data above show that the reactions are thermodynamically favorable.

EXAMPLE 1

Jaguar ore, having the composition described in the table below, was mixed to ferric sulfate in the proportion of 200 grams of ore to 2.5 grams of anhydrous ferric sulfate (stoichiometric). After proper homogenization, the mixture was subjected to temperatures of 500° C. for 3 hours. After complete cooling of the material, water was added to form a pulp of 30% solids and the mixture was stirred for 1 hour.

The pulp was filtered and samples of the residue and of the PLS were sent for chemical analysis. Results indicated 85% nickel extraction, 77% copper extraction and 88% of cobalt extraction. Iron and other impurities were below 1%, with the exception of manganese, which obtained 97% extraction.

| Elemento | Cu | S | Al | Ca | Co | Fe | Mg | Ni | P | Si | Zn | K | Na |
|---|---|---|---|---|---|---|---|---|---|---|---|---|---|
| Unidade | % | % | % | % | % | % | % | % | % | % | % | % | % |
| Análise | 0.092 | 4,230 | 3,097 | 1,552 | 0.059 | 34,025 | 4,628 | 0.952 | 0.387 | 10,200 | 0.649 | 0.278 | 0.085 |
| Ag | Hg | Ba | Bi | Cd | Cr | Mn | Mo | Pb | Sn | Ti | V | Sb | LOI |
| ppm | ppb | % | % | % | % | % | % | % | % | % | % | ppm | % |
| 2,127 | <50 | <0.01 | <0.03 | <0.01 | <0.01 | 0.04 | <0.01 | <0.01 | 0.093 | 0.642 | 0.025 | 6,622 | 4,006 |

EXAMPLE 2

Jaguar ore, having the composition described in the table below, was mixed to ferric sulfate in the proportion of 200 grams of ore to 2.5 grams of anhydrous ferric sulfate (120% of the stoichiometric). After proper homogenization, the mixture was subjected to temperatures of 600° C. for 2 hours. After complete cooling of the material, water was added to form a pulp of 30% solids and the mixture was stirred for 1 hour. The pulp was filtered and samples of the residue and of the PLS were sent for chemical analysis. Results indicated 92% nickel extraction, 79% copper extraction and 93% of cobalt extraction. Iron and other impurities were below 1%, with the exception of manganese, which obtained 99% extraction.

| Elemento | Cu | S | Al | Ca | Co | Fe | Mg | Ni | P | Si | Zn | K | Na |
|---|---|---|---|---|---|---|---|---|---|---|---|---|---|
| Unidade | % | % | % | % | % | % | % | % | % | % | % | % | % |
| Análise | 0.133 | 5,332 | 3,141 | 6,267 | 0.038 | 17,410 | 4,762 | 1.261 | 2067 | 16,453 | 1081 | 1 | 0.561 |
| Ag | Hg | Ba | Bi | Cd | Cr | Mn | Mo | Pb | Sn | Ti | V | Sb | LOI |
| ppm | ppb | % | % | % | % | % | % | % | % | % | % | ppm | % |
| 5,711 | <50 | <0.01 | <0.03 | <0.01 | <0.01 | 0.089 | <0.01 | 0.38 | 0.278 | 0.084 | 0.017 | 5,937 | 4,949 |

EXAMPLE 3

Jaguar ore, having the composition described in the table below, was mixed to ferric sulfate in the proportion of 200 grams of ore to 2.5 grams of anhydrous ferric sulfate (130% of the stoichiometric). After proper homogenization, the mixture was subjected to temperatures of 600° C. for 2 hours. After complete cooling of the material, water was added to form a pulp of 30% solids and the mixture was stirred for 1 hour. The pulp was filtered and samples of the residue and of the PLS were sent for chemical analysis. Results indicated 98% nickel extraction, 82% copper extraction and 94% of cobalt extraction. Iron and other impurities were below 1%, with the exception of manganese, which obtained 99% extraction.

| Elemento | Cu | S | Al | Ca | Co | Fe | Mg | Ni | P | Si | Zn | K | Na |
|---|---|---|---|---|---|---|---|---|---|---|---|---|---|
| Unidade | % | % | % | % | % | % | % | % | % | % | % | % | % |
| Análise | 0.133 | 5,332 | 3,141 | 6,267 | 0.038 | 17,410 | 4,762 | 1.261 | 2067 | 16,453 | 1081 | 1 | 0.561 |
| Ag | Hg | Ba | Bi | Cd | Cr | Mn | Mo | Pb | Sn | Ti | V | Sb | LOI |
| ppm | ppb | % | % | % | % | % | % | % | % | % | % | ppm | % |
| 5,711 | <50 | <0.01 | <0.03 | <0.01 | <0.01 | 0.089 | <0.01 | 0.038 | 0.278 | 0.084 | 0.017 | 5,937 | 4,949 |

The invention claimed is:

1. A method of recovering base metals from sulphide ores, comprising:

mixing the sulfide ores with ferric salts having ratios between 50% by weight and 200% by weight to the base metals to form a mixture;

heating the mixture to temperatures between 400° C. and 600° C. for a period of 2 to 8 hours;

adding water to form a pulp; and stirring the pulp.

2. The method of claim 1, wherein the base metals are selected from the group consisting of copper, nickel and zinc.

3. The method of claim 1, wherein the base metals comprise nickel.

4. The method of claim 1, wherein the ferric salts comprise ferric sulphide, or ferric chloride, or a mixture thereof.

5. The method of claim 1, wherein the ratio between the ferric salts are between 90% by weight and 120% by weight to the base metals.

6. The method of claim 1, wherein adding the water to the mixture forms the pulp with 10% by weight to 33% by weight solids.

7. The method of claim 1, wherein adding the water to the mixture forms the pulp with 20% by weight to 30% by weight solids.

8. The method of claim 1, wherein stirring the pulp further comprises stirring for a period of 1 to 5 hours.

9. The method of claim 1, wherein stirring the pulp further comprises stirring for a period of 2 to 4 hours.

10. A method of recovering base metals from sulphide ores, the method comprising:

mixing the sulfide ores with ferric salts whose ratios are between 50% by weight and 200% by weight to the base metals;

heating the mixture to temperatures between 400° C. and 600° C. for a period of 2 to 8 hours;

adding water to form a pulp; and stirring the pulp;

wherein the base metals comprise zinc.

* * * * *